US006983487B2

(12) United States Patent
Rickon

(10) Patent No.: US 6,983,487 B2
(45) Date of Patent: Jan. 10, 2006

(54) BASEBALL CATCHER'S MASK

(75) Inventor: James Rickon, Sagamore Hills, OH (US)

(73) Assignees: James F. Rickon, Jr., Warren, OH (US); Patricia L. Spencer, Warren, OH (US); James B. Zdesar, Warren, OH (US)

( * ) Notice: Subject to any disclaimer, the term of this patent is extended or adjusted under 35 U.S.C. 154(b) by 0 days.

(21) Appl. No.: 10/410,821

(22) Filed: Apr. 9, 2003

(65) Prior Publication Data

US 2004/0199972 A1 Oct. 14, 2004

(51) Int. Cl.
*A42B 1/00* (2006.01)

(52) U.S. Cl. ..... 2/9

(58) Field of Classification Search ..... 2/9, 2/424, 425, 10; D29/111
See application file for complete search history.

(56) References Cited

U.S. PATENT DOCUMENTS

| | | | | | |
|---|---|---|---|---|---|
| 571,437 | A | * | 11/1896 | Gray | 2/9 |
| 861,170 | A | | 7/1907 | Gamble et al. | |
| 881,957 | A | | 3/1908 | Ridlon | |
| 1,488,812 | A | * | 4/1924 | Goodman | 2/9 |
| 2,020,248 | A | * | 11/1935 | Shibe | 2/9 |
| 2,502,377 | A | * | 3/1950 | Goldsmith et al. | 2/9 |
| 2,627,602 | A | * | 2/1953 | Goldsmith | 2/9 |
| 2,698,434 | A | | 1/1955 | Davia | |
| 3,220,014 | A | * | 11/1965 | Strohm et al. | 2/9 |
| 3,373,443 | A | * | 3/1968 | Marietta | 2/9 |
| 3,729,745 | A | * | 5/1973 | Latina | 2/9 |
| 3,732,574 | A | * | 5/1973 | Hale | 2/9 |
| 4,736,466 | A | | 4/1988 | Kallstrom | |
| 5,093,936 | A | * | 3/1992 | Copeland et al. | 2/419 |
| 5,148,550 | A | * | 9/1992 | Hodgkinson et al. | 2/424 |
| 5,206,955 | A | | 5/1993 | Milligan | |
| 5,267,353 | A | * | 12/1993 | Milligan | 2/9 |
| 5,394,564 | A | | 3/1995 | Rodriguez | |
| 5,737,770 | A | * | 4/1998 | Chen | 2/9 |
| 5,815,848 | A | | 10/1998 | Jarvis | |
| 5,953,761 | A | | 9/1999 | Jurga | |
| 6,189,156 | B1 | * | 2/2001 | Loiars | 2/424 |
| D448,528 | S | * | 9/2001 | Fujimoto et al. | D29/111 |
| 6,292,954 | B1 | * | 9/2001 | O'Bradaigh et al. | 2/424 |

FOREIGN PATENT DOCUMENTS

JP 2003055829 A * 2/2003

* cited by examiner

*Primary Examiner*—Rodney M. Lindsey
(74) *Attorney, Agent, or Firm*—Brouse McDowell; Roger D. Emerson; Daniel A. Thomson

(57) ABSTRACT

A protective headgear, such as a baseball catcher's mask, is disclosed. The protective headgear includes a shell, a cage, padding, and a strap/harness device. The shell includes a flared jaw area providing protection to the player/wearer's jaw. The cage includes a throat protection portion that extends downward, past the shell, and a flared ear portion, flaring away from the wearer's face, which keeps balls in front of the player/wearer. Padding is strategically placed inside the chin and forehead areas for protection. The protective headgear is designed to be used with a separate catcher's skull helmet. The strap/harness device is used to connect the protective headgear to the separate catcher's skull helmet.

18 Claims, 12 Drawing Sheets

BASEBALL CATCHER'S MASK

I. BACKGROUND OF THE INVENTION

A. Field of Invention

This invention pertains to the art of protective head devices for use by athletes. The invention relates more specifically to a facemask used by baseball catchers.

B. Description of the Related Art

It is known in the art that there have been only two general types of catcher's masks used in both amateur and professional baseball. The conventional mask is the "official" catcher's mask. Although the mask is adequate, the wearer's visibility while wearing the "official" catcher's mask is limited. Also, the jaw protection offered is poor and the impact of a foul ball is harsh. While players continue to use the "official" catcher's mask, there are a number of improvements that can be made to the mask.

Also known in the art is the "hockey-style" catcher's mask. While the "hockey-style" mask provides what is lacking in the "official" catcher's mask, the hockey-style catcher's mask is heavier, much larger, uncomfortable to wear, difficult to flip on and off during play, provides no rear neck protection, and looks like a hockey mask, not a baseball catcher's mask. The way a catcher's mask looks is important since baseball is a game filled with tradition. Anything that seems to take away from that tradition is frowned upon by players and fans alike. In addition, the "hockey-style" mask makes the head area of the wearer uncomfortably hot and when the mask is removed, the wearer is bare-headed and not provided any head protection. Therefore, the "hockey-style" catcher's mask is undesirable for the game of baseball, and has a number of needed improvements.

Also known in the art are "skull helmets" of U.S. Pat. No. 2,698,434, to Davia. This patent discloses the use of baseball caps, or "skull helmets", that are used to protect the player's head. The most used skull helmet is made by American Baseball Cap. This cap or helmet works well for its intended purpose, but it does not provide any face protection.

The present invention achieves the combined advantages of the traditional "official" catcher's mask and the "hockey-style" catcher's mask without the disadvantages.

The present invention provides methods and apparatuses for a baseball catcher's mask. This invention obviates the foregoing difficulties and others while providing better and more advantageous overall results.

II. SUMMARY OF THE INVENTION

According to one aspect of the present invention, a new and improved catcher's mask is provided which is a cage and shell combination with a strap/harness device on the back. This new mask is designed to be worn with a separate catcher's "skull helmet," and is known as "G-3."

According to another aspect of the present invention, a head protection device for use by athletes comprises a concave shell with a crown portion, forehead portion, chin portion, two jaw portions, two side portions and an elongated view opening between the forehead and the chin portions.

According to another aspect of the invention, a forehead portion is connected to a chin portion by two side portions and two jaw portions.

According to another aspect of the invention, the two side portions end vertically, toward the rear of the mask, prior to, and rather than, extending over and covering the wearer's ears.

According to another aspect of the invention, the jaw portions follow the contour of the wearer's jaw until the two jaw portions connect with the two side portions. At this connection point, the side portions, in conjunction with the jaw portions, flare outward, away from the wearer's head.

According to another aspect of the invention, the crown portion extends over the front half of the wearer's head and ends before the midpoint of the front half and back half of the wearer's head.

According to another aspect of the invention, the head protection device comprises a forehead interior surface having padding therein, a chin interior surface having padding therein, and an exterior rear harness device thereon.

According to another aspect of the invention, the harness device comprises a strap connected at strategic points on the head protection device.

According to another aspect of the invention, the head protection device includes a shell to be used with a separate catcher's skull helmet.

According to another aspect of the invention, the head apparatus device further comprises a shell that covers and protects the wearer's forehead, jaw, chin, cheeks, mouth, and ears.

According to another aspect of the invention, the head apparatus device is adapted to receive a cage.

According to another aspect of the invention, the cage substantially covers an elongated view opening of the shell.

According to another aspect of the invention, the cage includes a lower portion extending downward over the wearer's throat area, and two ear portions that extend outward away from the wearer's face.

According to another aspect of the invention, a method is provided for assembling a head protection device for use by athletes where the head protection device comprises a concave shell having a crown portion, forehead portion, chin portion, two jaw portions, and two side portions. The method further comprises the steps of providing an elongated view opening between a forehead portion and a chin portion and connecting a forehead portion to a chin portion by using two side portions and two jaw portions.

According to another aspect of the invention, the method further comprising the step of covering an interior forehead surface and interior chin surface with padding.

According to yet another aspect of the invention, the method further comprising the steps of providing a protective cage and connecting the cage to the shell.

According to another aspect of the invention, the method further comprising the steps of providing a harness device and a separate skull helmet.

According to yet another aspect of the invention, the method further comprising the steps of ending the side portions vertically, prior to the position where the side portions would cover the wearer's ears.

According to another aspect of the invention, the method comprising the step of flaring a jaw portion and the side portions together in a direction away from the wearer's face.

According to another aspect of the invention, the method also comprising the step of ending a crown portion before the halfway point between the front half and back half of the wearer's head.

According to still another aspect of the invention, the method further comprising the steps of attaching a separate catcher's skull helmet to the shell by means of a harness device.

According to another aspect of the invention, where the head protection device is a catcher's mask.

One advantage of this invention is the full protection of the face, throat, back of the neck, jaw, ears, and head. The shell extends down to protect the jaw area. Also, the cage extends downward past the shell portion, making this portion of the cage an extended throat guard, providing protection to the front of the throat area. The mask also utilizes a jaw area that flares out, rather than following the contour of the jaw, which better protects the jaw area. The separate catcher's skull helmet, worn backwards, protects the back area of the neck. The mask absorbs shock from impact rather than the face of the wearer because of the design of the cage, combined with a shell.

Still another advantage of this invention is that the mask, worn with a separate skull helmet, reduces shock to the face since there are three masses, namely, the cage, the shell, and the skull helmet, that absorb the shock which protects the player/wearer.

Another advantage is that the wide ear protectors of the cage keep balls in front of the player, and help block balls that were thrown in the dirt.

Another advantage is that the shell, combined with the cage, results in less foul ball shock to the face by using a cage, shell, and skull helmet combination.

Another advantage of this invention is that the mask provides the capability of providing a clear unobstructed view for the wearer/player. The viewing opening in the shell of the new mask is elongated. The new design of the mask brings the cage portion of the mask close to the face in a safe manner. This gives excellent side to side, up and down, and straight ahead vision to the player/wearer.

Still another advantage is the comfort while wearing the mask. The mask is cool to the face and head, and lightweight. The G-3 mask hangs closer to center of the head, making it feel lighter than it actually is and lighter than the traditional catcher's mask or the hockey-style catcher's mask.

Another advantage of the present invention is that the mask sits comfortably and easily on the top of the head when not in use.

Yet another advantage is the ease with which the wearer can flip the mask on and off during play through use of a strap/harness device on the back of the mask.

Yet another advantage is that the use of the mask with a separate skull helmet means the player/wearer is not "bare headed" when the mask is removed.

Still another advantage is that this mask looks similar to the traditional baseball mask. Most, if not all, players of the game of baseball desire to wear a mask that looks like a familiar and common baseball catcher's mask. Baseball is a game filled with tradition and the use of a baseball catcher's mask that looks like a baseball catcher's mask is highly desired.

Another advantage is that the mask is durable and the wearer/player may personalize the shell of the facemask with logos and graphics of any possible color or style.

Yet another advantage is that it is compact, and easy to pack in a bag. The "hockey-style" facemask is one unit that covers the entire head of the wearer. The present invention only covers the front portion of the head, making it, in effect, a "half" shell. This means it takes up less room when stored or placed in a bag for carrying.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, at least one embodiment of which will be described in detail in this specification and illustrated in the accompanying drawings which form a part hereof and wherein.

Figure 6A:
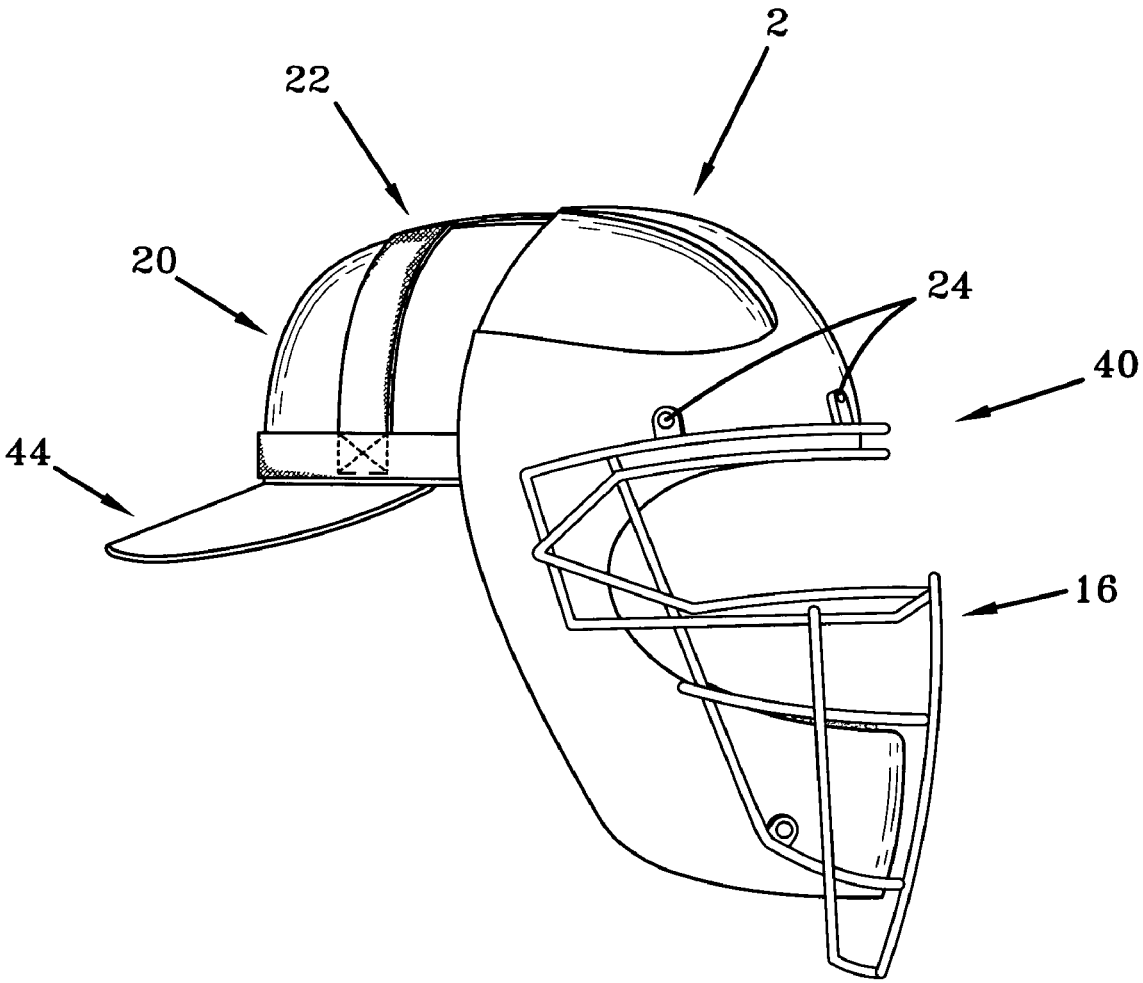
Figure 6B:
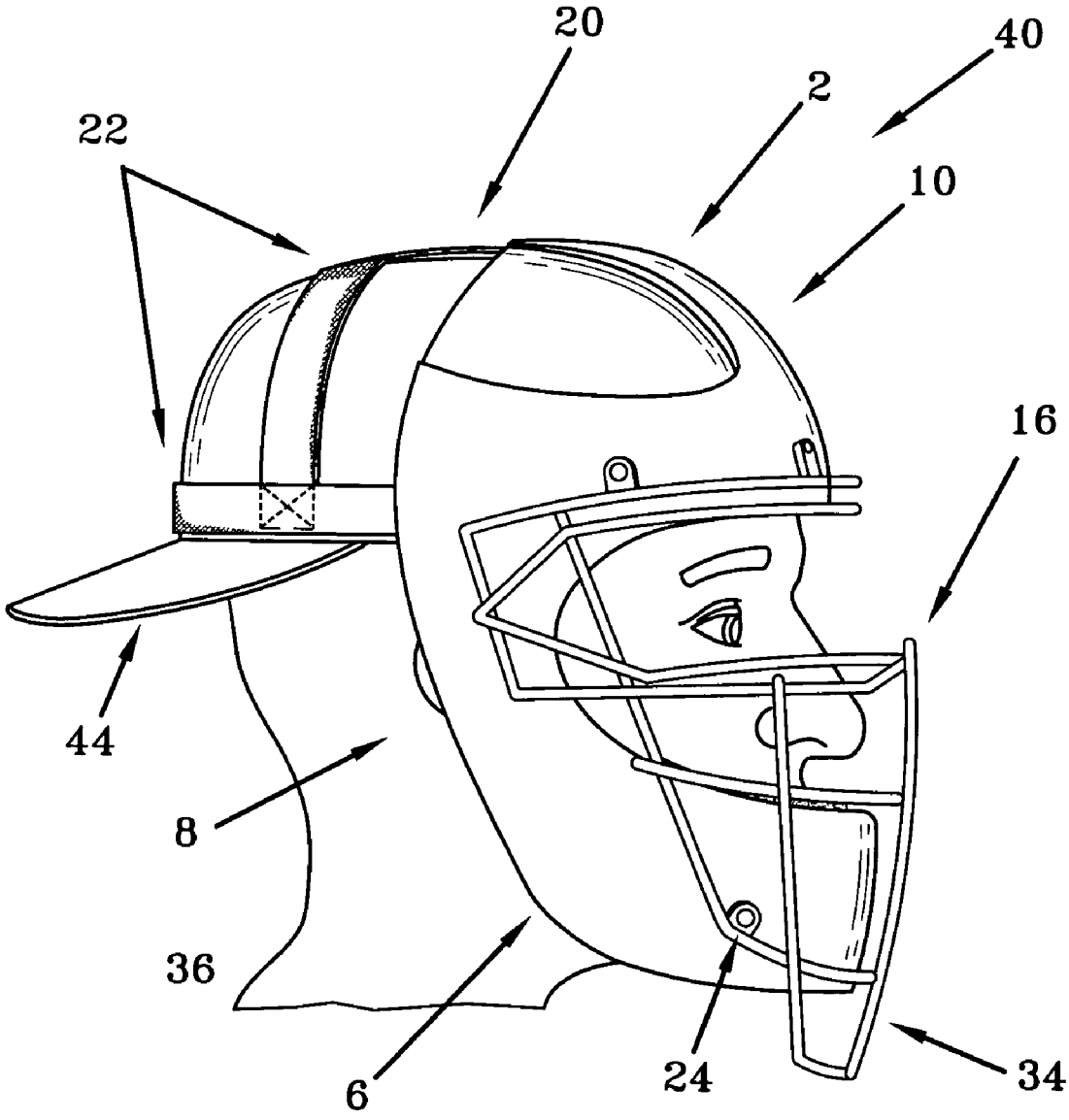
Figure 7:
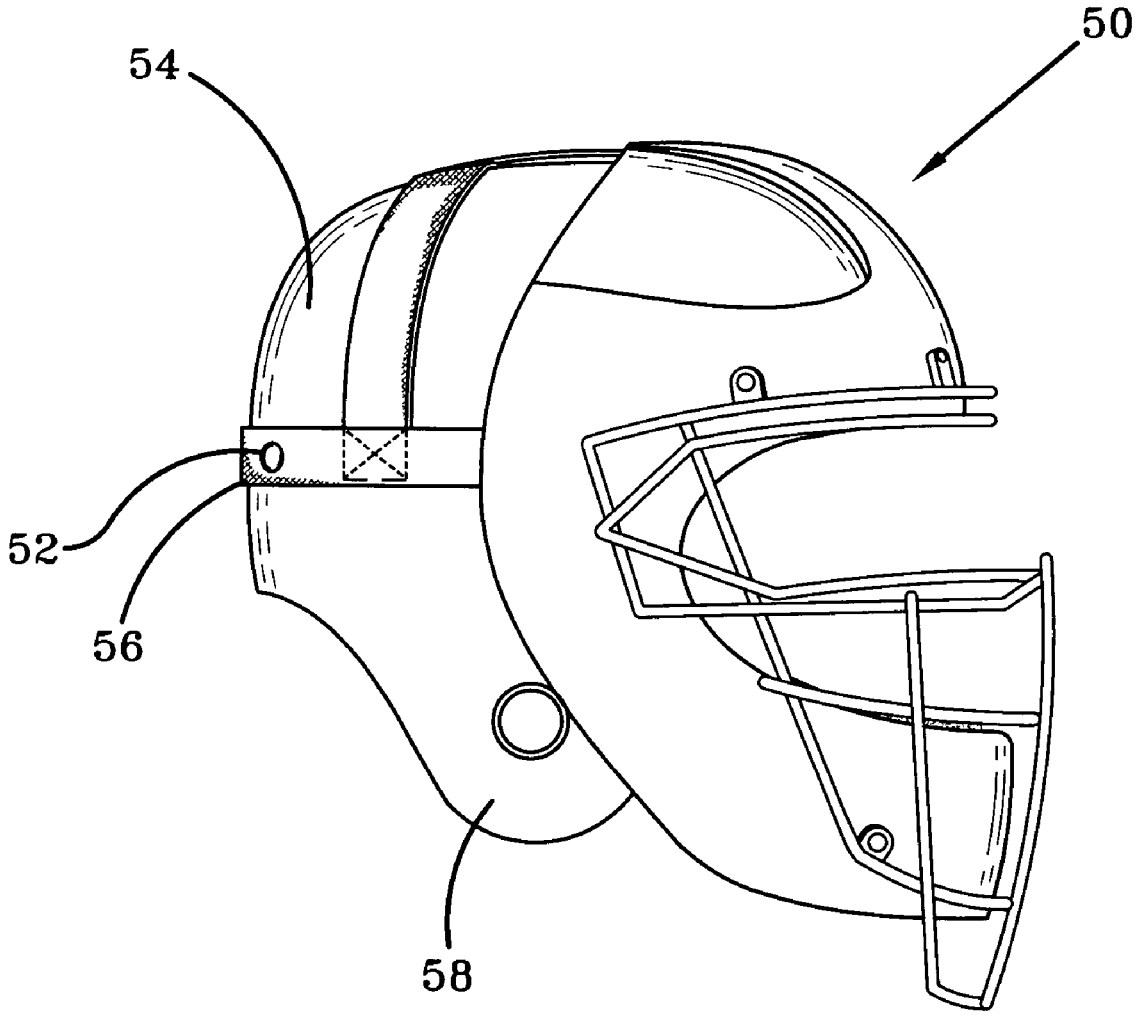
Figure 8:
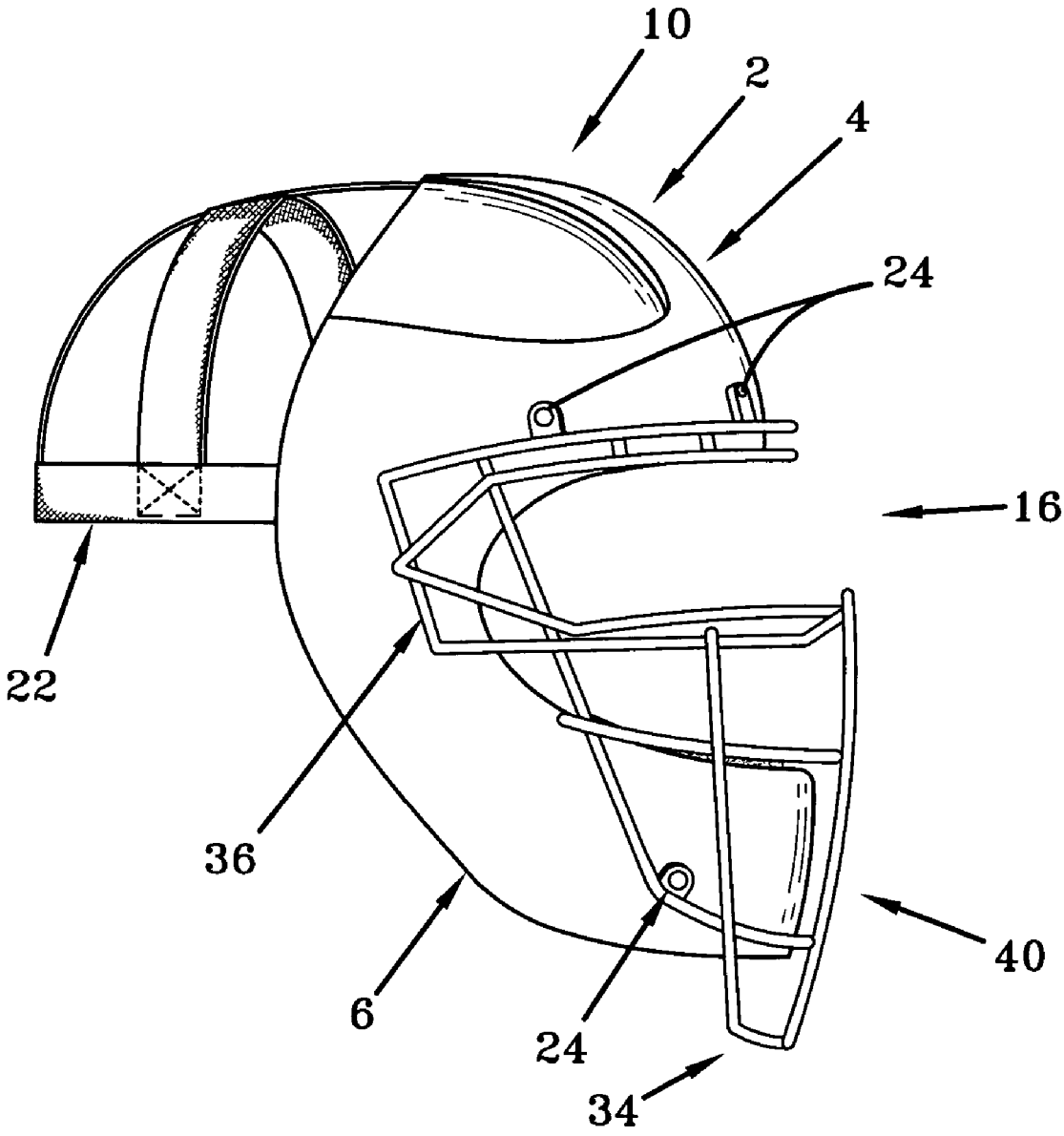
Figure 9A:
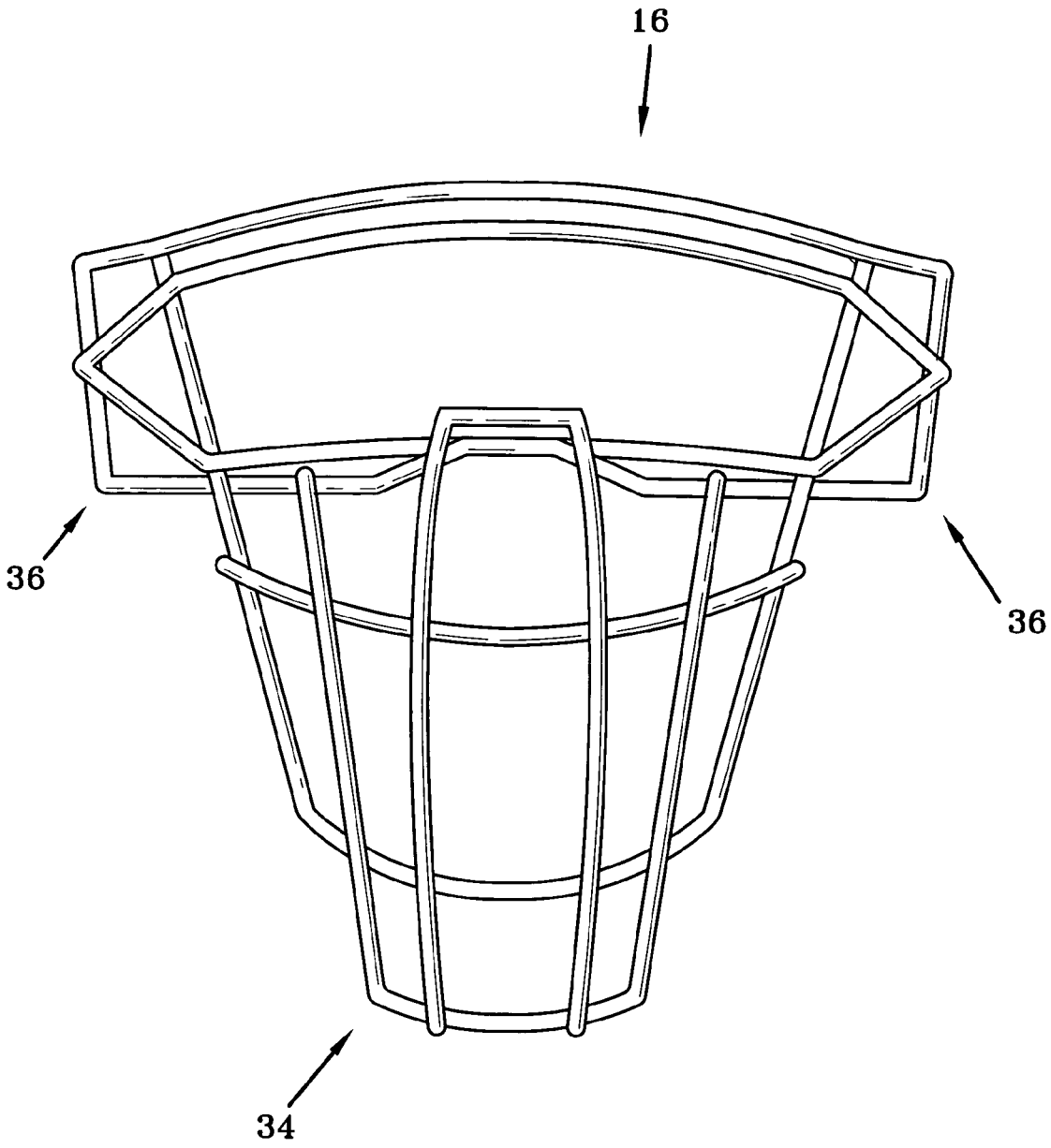
Figure 9B:
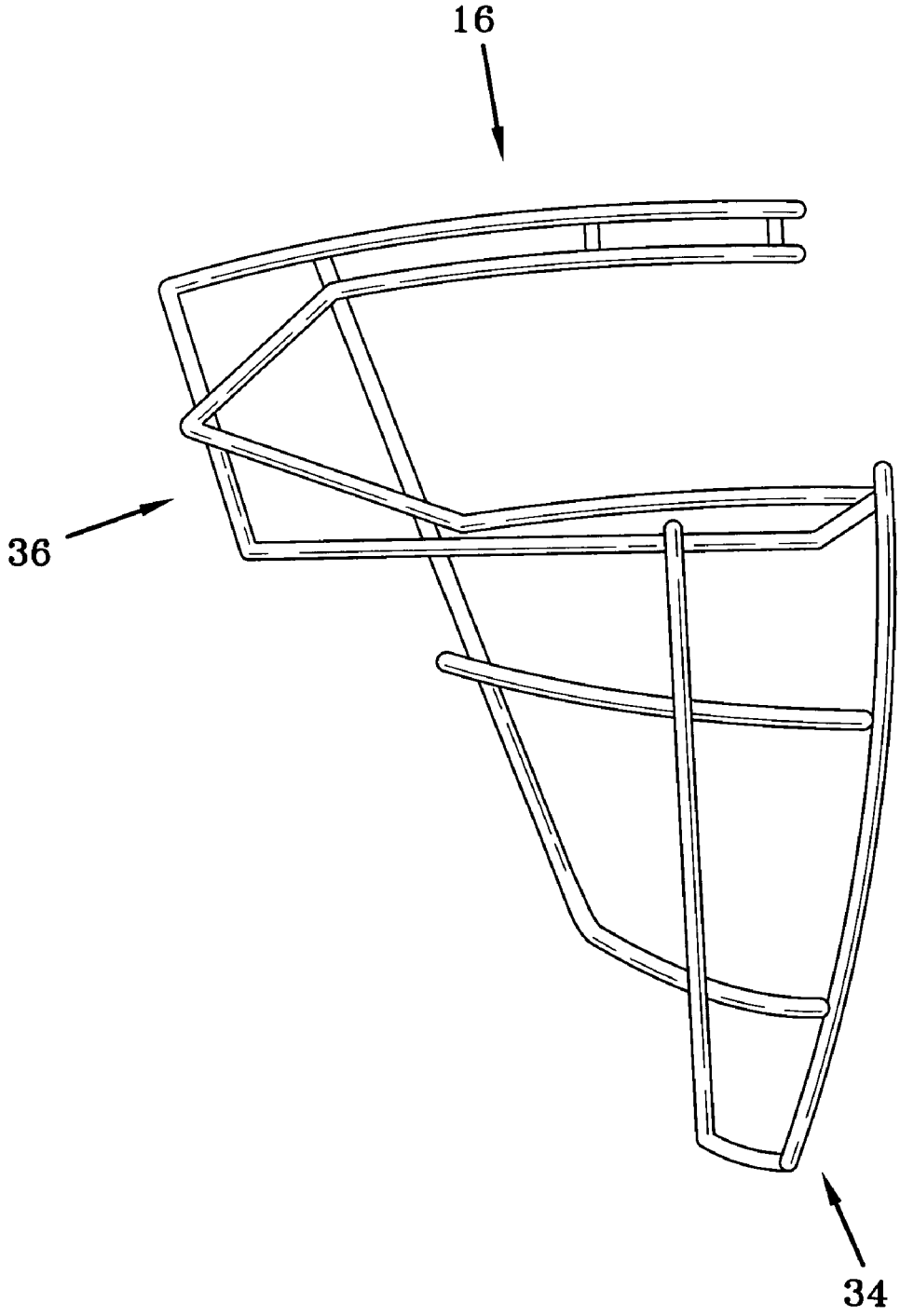
Figure 10:
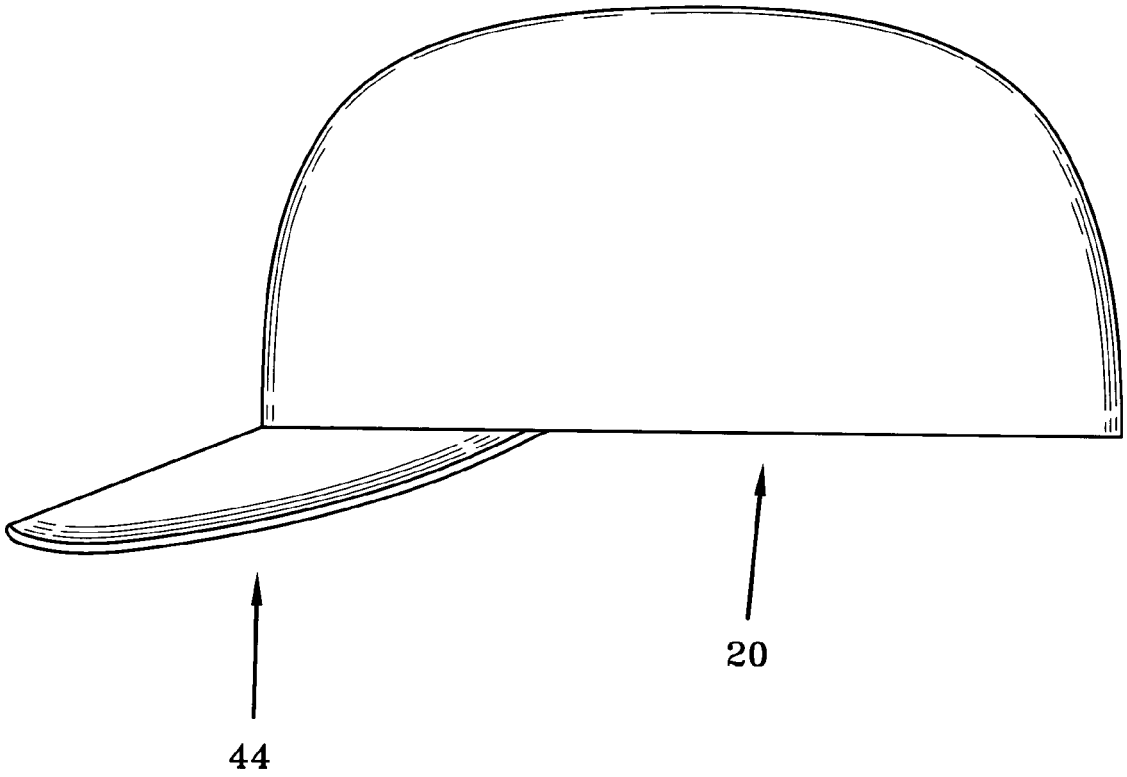

FIG. 6*a* is a side view of the facemask attached to the skull helmet;

FIG. 6*b* is a side view of the facemask attached to the skull helmet as worn by player;

FIG. 7 is a side view of a second embodiment of the facemask attached to a skull helmet;

FIG. 8 is a side view of the shell with cage and attachment means;

FIG. 9*a* is a front view of the cage;

FIG. 9*b* is a side view of the cage; and,

FIG. 10 is a side view of the separate catcher's skull helmet.

IV. DESCRIPTION OF THE INVENTION

Figure 1:
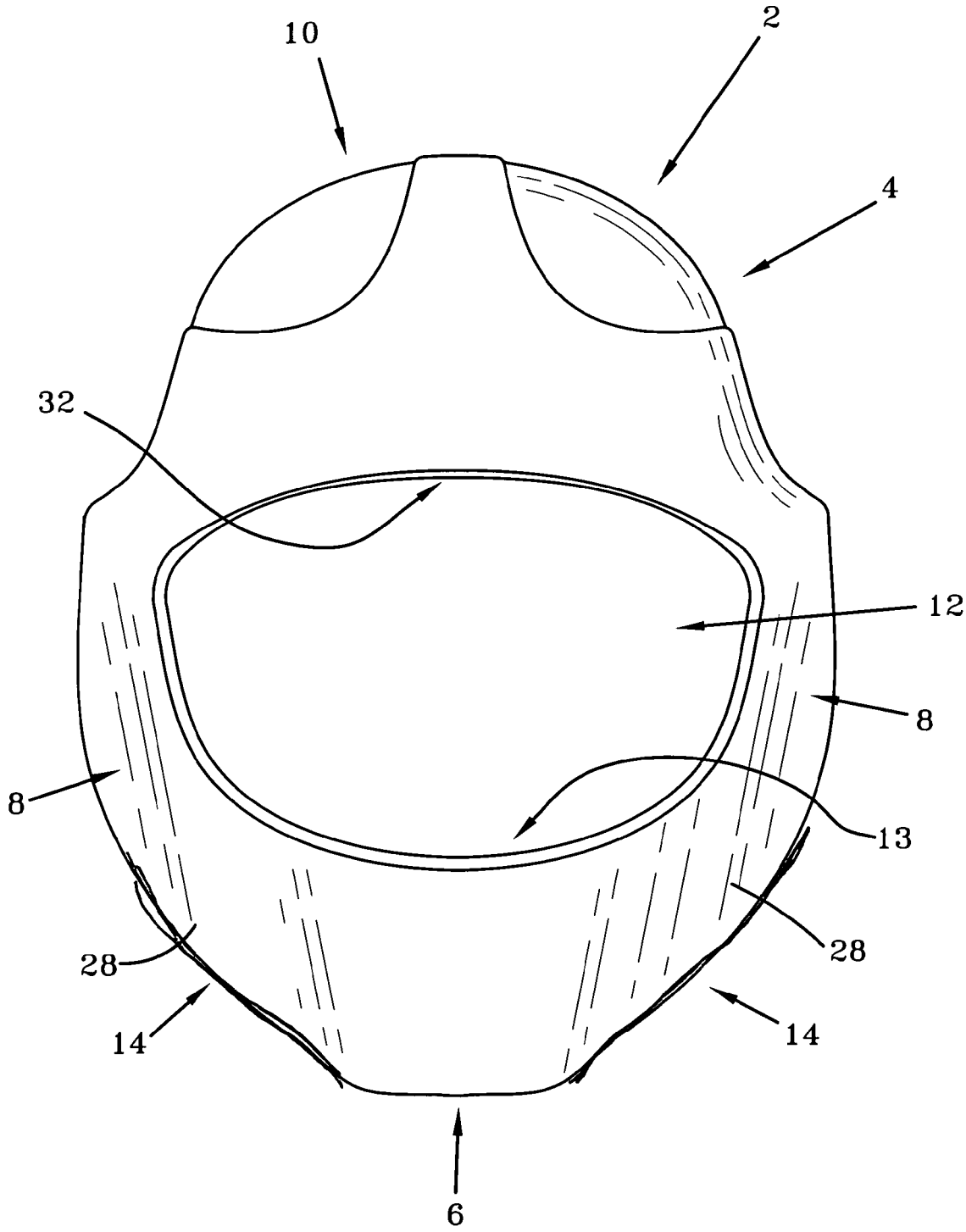
FIG. 1 is a front view of the shell.
Figure 4:
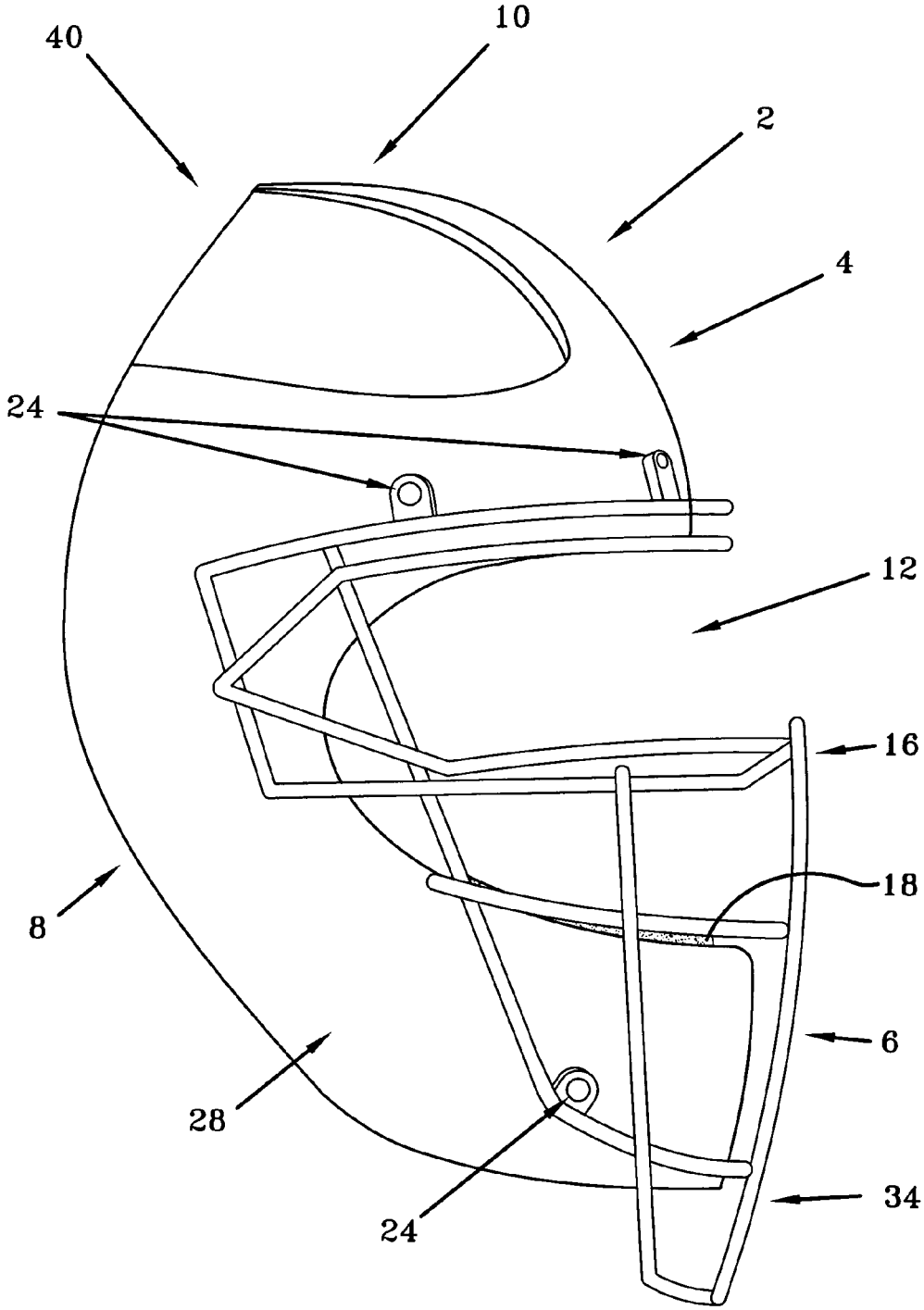
FIG. 4 is a side view of the cage attached to the shell.

Referring now to the drawings wherein the showings are for purposes of illustrating at least one embodiment of the invention only and not for purposes of limiting the same, FIG. 1 shows a front view of a shell shown generally at 2, as if looking at the player while the player is wearing a facemask 40, as shown in FIG. 4. The shell 2 has a forehead portion 4, two jaw portions 28, a chin portion 6, and two vertical side portions 8. The two side portions 8 connect the forehead portion 4 to the jaw portion 28 and to the chin portion 6. The side portions 8 provide protection for the sides of the face and the ear area.

Between the chin portion 6 and the forehead portion 4 there is an elongated view opening area 12. This opening provides a view opening for the player to look through. The elongated design of the view opening area 12 provides the wearer with greater visibility, no constriction to breathing through the nose, and enough room for the mouth, so the wearer can talk and others can hear and understand what the wearer is saying. In this embodiment, the height of the front view opening 12 of the shell 2 is approximately 4 inches, plus or minus 1.5 inches, and, the width of the front view opening 12 of the shell 2 is approximately 7 inches, plus or minus 1.5 inches. In another embodiment, the width of the front view opening 12 of the shell 2 is approximately 7.25 inches, plus or minus 0.5 inches, and, the height of the front view opening 12 of the shell 2 is approximately 4.5 inches, plus or minus 0.5 inches.

Continuing with reference to FIG. 1, the shell 2 is designed so a crown portion 10, sits comfortably on the separate catcher's skull helmet, worn by the player/wearer. A view of the separate catcher's skull helmet is shown in FIG. 10. In this embodiment, the distance between the shell 2 and the player/wearer's forehead is approximately 2 inches, plus or minus 1.25 inches, the width of the shell 2 is approximately 9 inches, plus or minus 2 inches, the height of the shell 2 is approximately 11 inches, plus or minus 2 inches, and, the depth of the shell 2 is approximately 5 inches, plus or minus 2 inches. In another embodiment, the distance between the shell 2 and the player/wearer's forehead is approximately 1.75 inches, plus or minus 0.5 inches, the width of the shell 2 is approximately 9.5 inches, plus or minus 0.5 inches, the height of the shell 2 is approximately 10.5 inches, plus or minus 0.5 inches, and, the depth of the shell 2 is approximately 4.75 inches, plus or minus 0.5 inches. The shell 2 may be made out of plastic, fiberglass, Kevlar®, or any other type of material chosen with sound engineering judgment.

Continuing with reference to FIG. 1, the jaw portion 28 follows the contour of the wearer's jaw until the jaw portion 28 and the side portions 8 connect at connection points 14. At the connection points 14, the jaw portion 28, in conjunction with the side portions 8, flares outward, away from the wearer's head or face area. This flaring helps to protect the player/wearer's jaw as it tends to block balls away from the player/wearer's face area. In this embodiment, the flared portion follows an approximate 45° angle, plus or minus 10°. However, any angle, chosen with sound engineering judgment, may be used to achieve a flared portion angled away from the wearer's head or face area.

Figure 2:
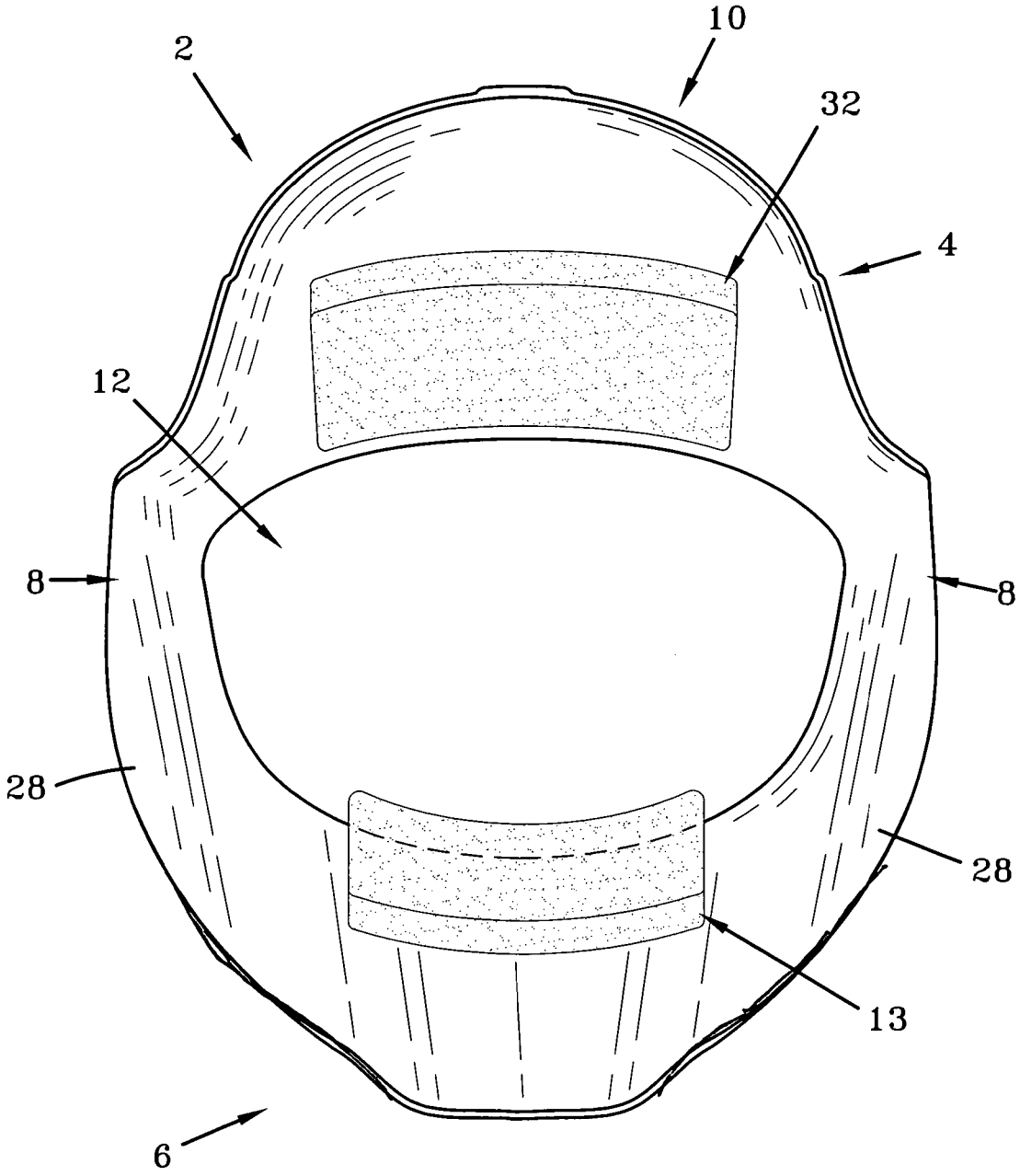
FIG. 2 is a rear view of the shell with padding.

Referring now to FIG. 2, a rear view of the shell 2, as seen from the wearer's point of view is shown. Attached on the inside of the chin portion 6 of the shell 2 is protective chin padding 13. The chin padding 13 cushions the wearer's jaw or chin. The chin padding 13 may be any firm, soft substance chosen with sound engineering judgment and may be covered or not covered. In this embodiment, the thickness of chin padding 13 is approximately 1 inch, plus or minus 0.5 inches, the height of the chin padding 13 is approximately 3 inches, plus or minus 1 inch, and, the width of the chin padding 13, while the padding is in the designated shell 2 area, is approximately 5 inches, plus or minus 1.5 inches. In another embodiment, the thickness of the chin padding 13 is approximately 1.25 inches, plus or minus 0.25 inches, the height of the chin padding 13 is approximately 3.25 inches, plus or minus 0.25 inches, and, the width of the chin padding 13, while the padding is in the designated shell 2 area, is approximately 4.5 inches, plus or minus 0.5 inches.

With continuing reference to FIG. 2, there is also forehead padding 32 attached on the inside of the forehead portion 4 of the shell 2. The forehead padding 32 is for protection of the wearer/player's forehead and to provide friction between the shell 2 and the separate catcher's skull helmet 20, as shown in FIG. 6*a*. The forehead padding 32 may be any soft, firm substance chosen with sound engineering judgment and may be either covered or uncovered. In this embodiment, the thickness of the forehead padding 32 is approximately 1 inch, plus or minus 0.75 inches, the height of the forehead padding 32 is approximately 5 inches, plus or minus 1.5 inches, and, the width of the forehead padding 32, while the padding is in the designated shell 2 area, is approximately 7 inches, plus or minus 1.5 inches. In another embodiment, the thickness of the forehead padding 32 is approximately 0.75 inches, plus or minus 0.25 inches, the height of the forehead padding 32 is approximately 4.75 inches, plus or minus 0.5 inches, and, the width of the forehead padding 32, while the padding is in the designated shell 2 area, is approximately 7.5 inches, plus or minus 0.5 inches.

Figure 3:
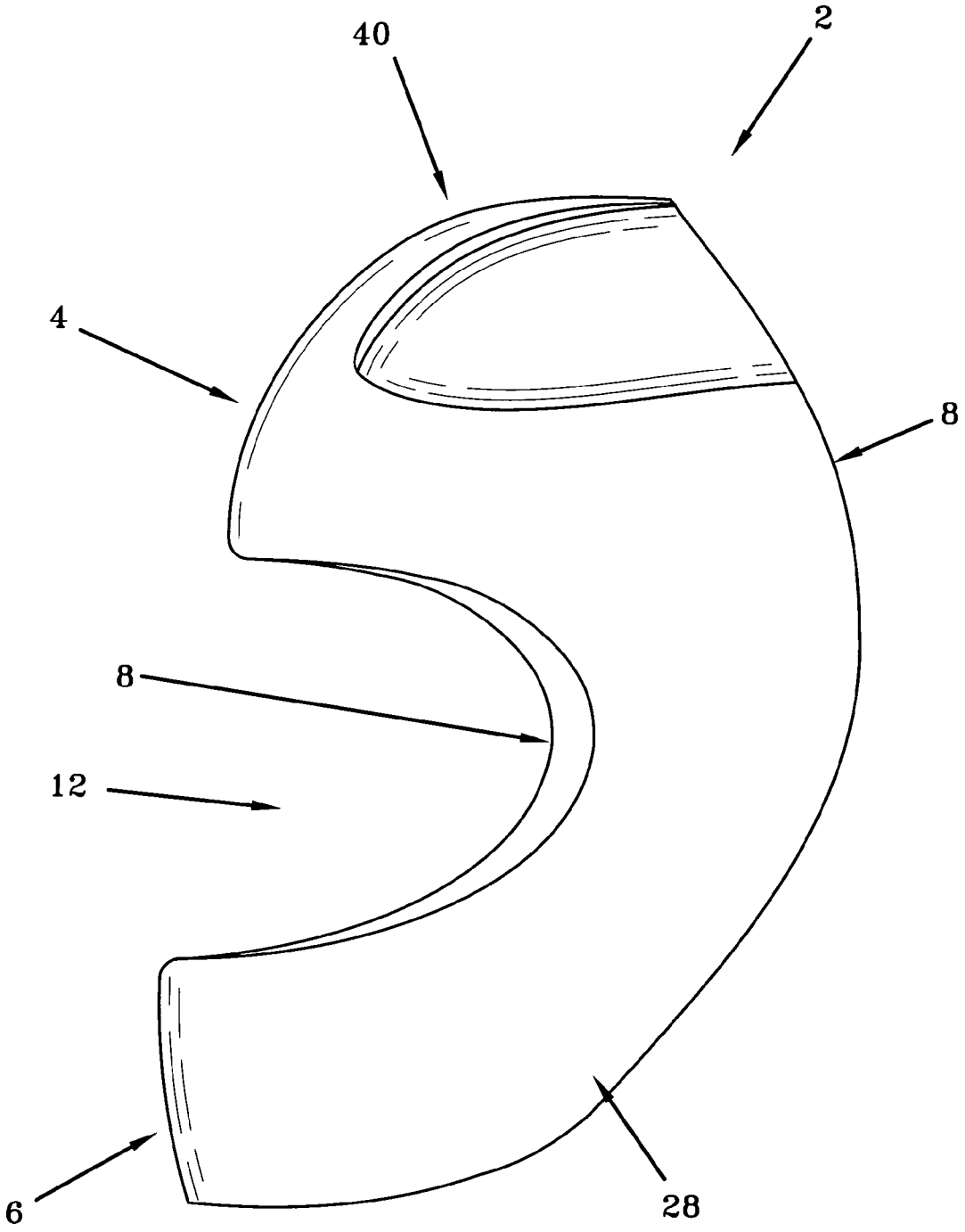
FIG. 3 is a side view of the shell.

Referring now to FIG. 3, a side view of the shell 2 is shown. The side portions 8 of the shell 2 terminate or end before the shell 2 covers the wearer's ears. The crown portion 10 also stops just before the midpoint of the player/wearer's head. This results in a "half" shell that covers the player/wearer's face and front half of the wearer's skull area. A half shell concept is used so that the player/wearer may also wear a separate skull helmet 20, as shown in FIG. 6*a*. The skull helmet 20 may be worn backwards on the player/wearer's head. The use of a separate skull helmet 20 is desirable as the helmet brim 44 provides protection for the back of the neck. Other benefits of a "half" shell are that the mask 40 is compact and easy to store or carry in a bag. The player/wearer, before taking off the mask 40, may push the mask 40 up onto the skull helmet 20 and take off the combination in this compact form or just take off the mask 40 and leave on the helmet 20. This helps reduce the player/wearer's burden while moving the catcher's mask 40, and other equipment, to the various playing fields. It also makes storage of the catcher's mask 40 in lockers between games easier since some lockers may be too small to hold the hockey-style "full" helmet.

With reference to FIGS. 9*a* and 9*b* a front and side view of one embodiment of the cage is shown. Although the Figures show one embodiment of the cage configuration, design or pattern, it is understood that the present invention will work equally well with other patterns, designs or cage configurations, chosen with sound engineering judgment.

Figure 5:
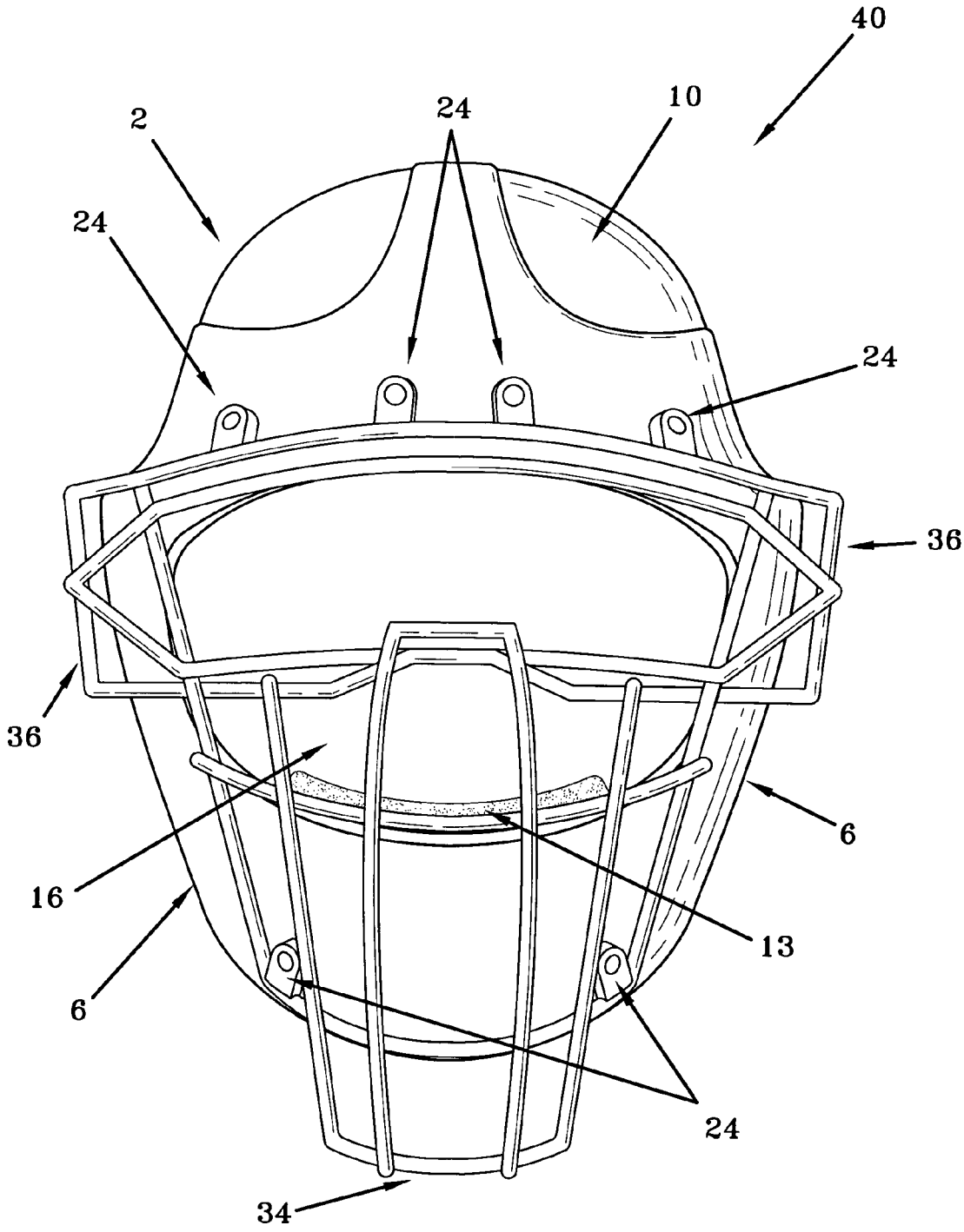
FIG. 5 is a front view of the cage attached to the shell.

Referring now to FIGS. 4 and 5, a side and a front view of a cage 16 attached to the shell 2 is shown. The cage 16 may be attached to the shell 2 using a connection means 24 that is preferably screws and clamps, of which a representative few are shown. Although placement of the connection means 24 is shown, it is understood that the location of the connection means 24 may be selectively placed in various locations on the mask 40. It is also understood that other means of securing the cage 16 to the shell 2 may be used as determined with sound engineering judgment. In this embodiment, the cage 16 is made out of steel. However, titanium, metal, alloy, aluminum, or any other type of material may be chosen with sound engineering judgment.

With continued reference to FIGS. 4 and 5, the lower portion of the cage 16 extends downward past the chin portion 6, shown in FIG. 6*b*. This provides the player/wearer with a throat protector 34. This throat protector 34 may shield the player/wearer from a foul ball or wild pitch. The sides of the cage 16 extend outward in a direction away from the player/wearer's face making wide ear protectors 36. The extended ear protectors 36 keep balls in front of the player/wearer and help block balls that were thrown in the dirt. The extended ear protectors 36 and the throat protector 34 aid in safety and performance of the mask 40.

Continuing with reference to FIGS. 4 and 5, the cage 16 covers the elongated view opening 12 of the shell 2. The cage 16 protects the player/wearer's eyes, nose, and mouth from contact with the ball. The ball may hit the cage 16 rather than directly hitting the player/wearer. Thus, the shell 2, combined with the cage 16, results in less foul ball shock to the face. The mask 40 absorbs the shock from impact, saving injury to the player/wearer. Also, the design of the mask 40 brings the cage 16 close to the wearer's face in a safe manner. The close proximity of the cage 16 gives excellent side to side, up and down, and straight-ahead vision to the player/wearer. In this embodiment, the distance from the cage 16 of the mask 40 to the nose of the wearer is approximately 2 inches, plus or minus 1 inch, the width of the cage 16 is approximately 11 inches, plus or minus 2 inches, the height of the cage 16 is approximately 8 inches, plus or minus 2 inches, and, the depth of the cage 16 is approximately 5 inches, plus or minus 1.5 inches. In another embodiment, the distance from the cage 16 of the mask 40 to the nose of the wearer is approximately 1.5 inches, plus or minus 0.5 inches, the width of the cage 16 is approximately 11.5 inches, plus or minus 0.5 inches, the height of the cage 16 is approximately 8.5 inches, plus or minus 0.5 inches, and, the depth of the cage 16 is approximately 4.75 inches, plus or minus 0.5 inches.

Referring now to FIG. 6*a*, a side view of the facemask 40 attached or strapped to the skull helmet 20 is shown. The facemask 40, which consists of the shell 2 and cage 16 combination, is attached to the separate skull helmet 20 with an attachment device 22, that is preferably a strap or harness, on the back of the mask 40. The attachment device 22 may be made out of nylon and an elastic substance. However, any type of fabric, material, or any other type of device may be chosen with sound engineering judgment.

The attachment device 22 is operatively connected to the mask 40 at strategic points, chosen with sound engineering judgment. Another embodiment is shown in FIG. 8, a side view of the shell 2 and cage 16 combination and an attachment device 22 without the separate skull helmet.

With reference now to FIGS. 6*a* and 6*b*, the shell 2 is designed to fit snuggly around the separate catcher's skull helmet 20. This brings the mask 40 closer to the center of the head making the mask 40 feel lighter to the player/wearer than it actually is. This design also brings the cage 16 safely closer to the wearer's face, aiding in unobstructed vision. The separate catcher's skull helmet 20 also fits comfortably on the head. The forehead padding 32 may create friction, and better bonding, between the separate catcher's skull helmet 20 and the shell portion 2 of the mask 40. The lightweight characteristic of the mask 40 also makes it comfortable to the player/wearer. In this embodiment, the weight of the entire mask 40 is approximately 16 ounces, plus or minus 6 ounces, the height of the entire mask 40 is approximately 12 inches, plus or minus 2.5 inches, and, the depth of the entire mask 40 is approximately 6 inches, plus or minus 2 inches. In another embodiment, the weight of the entire mask 40 is approximately 15 ounces, plus or minus 1 ounce, the height of the entire mask 40 is approximately 12 inches, plus or minus 0.5 inches, and, the depth of the entire mask 40 is approximately 5.25 inches, plus or minus 0.5 inches.

With continued reference to FIG. 6*a*, the game of baseball is a tradition filled game. Anything that distracts or takes away from this tradition is "frowned" upon. The new design of the catcher's mask 40 keeps the "look" of a baseball mask while providing the desires and needs of the player/wearer. The new design also allows the player/wearer to place logos and graphics, as desired, on the shell 2 portion of the mask 40. This enables the player/wearer to personalize their mask, making it unique.

Referring now to FIG. 7, a side view of a second embodiment of the facemask attached to a skull helmet showing the present invention adapted for a youth version mask 50. It is known in the art that youth baseball rules require the separate catcher's skull helmet 54 to cover the ears 58 and to be connected to the mask 50 with a connection means 52, preferably snaps or buckles, to make it one unit. The second embodiment of the present invention, shown in FIG. 7, shows the facemask 50 adapted for the youth and little league rules. This second embodiment adjusts the design of the harness 56 by adding connection means 52 at strategic locations on the mask. The second embodiment is also adapted for the smaller size of the product to allow the appropriate fit for youths to wear.

With continuing reference to FIGS. 6*a* and 6*b*, the use of the attachment device 22 makes the newly designed facemask 40 easy to flip on and off during play. The player/wearer may grab the bottom portion of the mask 40 and while the player/wearer extends the mask 40 out and up, the elastic attachment device 22 makes for a quick and easy "off flip." This enables the player/wearer to keep the catcher's mask 40 on during the game or to quickly flip it off during the game. An example of this is when there is a pop-up foul ball or when the catcher has to field a bunt or wild pitch. The ability to flip up the facemask 40 onto the skull helmet 20 aids in making the unit compact for storage or for travel necessities. The player/wearer may also just rest the mask 40 on top of the head when the mask 40 is not in use during time outs.

At least one embodiment has been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

I claim:

1. A head and face protection apparatus comprising:

a concave shell with a crown portion, forehead portion, chin portion, two jaw portions and two side portions;

an elongated view opening between said forehead portion and said chin portion;

said forehead portion connected to said chin portion by means of said side portions and said jaw portions;

said side portions terminating vertically, toward the rear, prior to, and rather than, extending over and covering an associated wearer's ears;

said jaw portion following contour of said associated wearer's jaw until connection with said side portions;

said jaw portion, at said connection with said side portions, and in conjunction with said side portions, flaring outward, in a direction away from said associated wearer's head, such that the jaw portion and side portions form a concave shape;

said crown portion extending over the front half of said associated wearer's head; and, said crown portion terminating intermediate to the front half and back half of said associated wearer's head.

2. The head and face protection apparatus of claim 1 further comprising;

a forehead interior surface of said forehead portion with padding therein;

a chin interior surface of said chin portion with padding therein; and an exterior rear surface with a harness device thereon.

3. The head and face protection apparatus of claim 2 wherein said harness device includes a strap.

4. The head and face protection apparatus of claim 1 wherein said shell is adapted to an associated catcher's skull helmet.

5. The head and face protection apparatus of claim 1 wherein said shell is adapted to cover and protect said associated wearer's forehead, jaw, throat, cheeks, mouth, and ears.

6. The head and face protection apparatus of claim 1 wherein said shell is adapted to receive a cage device; said cage device is operatively connected to said shell and spaced a distance of 1 to 3 inches from associated wearer's nose.

7. The head and face protection apparatus of claim 6 wherein said cage device substantially covers said elongated view opening of said shell.

8. The head and face protection apparatus of claim 1 wherein said shell is made of plastic.

9. A head and face protection apparatus comprising:

a concave shell with a crown portion, forehead portion, chin portion, two jaw portions and two side portions, wherein said shell is adapted to receive a cage device, said cage device is operatively connected to said shell and spaced a distance of 1 to 3 inches from associated wearer's nose, wherein said cage device substantially covers said elongated view opening of said shell;

an elongated view opening between said forehead portion and said chin portion;

said forehead portion connected to said chin portion by means of said side portions and said jaw portions;

said side portions terminating vertically, toward the rear, prior to, and rather than, extending over and covering an associated wearer's ears;

said jaw portion following contour of said associated wearer's jaw until connection with said side portions;

said jaw portion, at said connection with said side portions, and in conjunction with said side portions, flaring outward, in a direction away from said associated wearer's head;

said crown portion extending over the front half of said associated wearer's head; and, said crown portion terminating intermediate to the front half and back half of said associated wearer's head, wherein said cage device includes a lower portion and two ear portions, said lower portion extending downward over associated wearer's throat area, and said ear portions extending outward away from said associated wearer's face.

10. The head and face protection apparatus of claim 9 further comprising:

a forehead interior surface of said forehead portion with padding therein;

a chin interior surface of said chin portion with padding therein; and an exterior rear surface with a harness device thereon;

said harness device includes a strap;

said shell is adapted to an associated catcher's skull helmet;

said shell is adapted to cover and protect said associated wearer's forehead, jaw, cheeks, mouth, and ears.

11. A head and face protection apparatus comprising:

a concave shell, the concave shell comprising:

a forehead portion;

a chin portion;

an elongated view opening between said forehead portion and said chin portion, wherein said elongated view opening extends behind an associated wearer's eyes;

a cage operatively connected to said shell;

a flexible harness device operatively connected to said shell;

said cage, said shell, and said harness device adapted for use with an associated skull helmet;

a crown portion, two jaw portions, and two side portions;

said forehead portion connected to said chin portion by means of said side portions and said jaw portions;

said side portions terminating vertically, toward the rear, prior to, and rather than, extending over and covering an associated wearer's ears;

said jaw portion following contour of said associated wearer's jaw until connection with said side portions;

said jaw portion, at said connection with said side portions, and in conjunction with said side portions, flaring outward, in a direction away from said associated wearer's head, such that the jaw portion and side portions form a concave shape;

said crown portion extending over the front half of said associated wearer's head; and, said crown portion terminating intermediate to the front half and back half of said associated wearer's head.

12. The head and face protection apparatus of claim 11 further comprising:

a forehead interior surface of said forehead portion with padding therein;

a chin interior surface of said chin portion with padding therein; and an exterior rear surface with a harness device thereon;

said harness device includes a strap;

said shell is adapted to an associated catcher's skull helmet;

said shell is adapted to cover and protect said associated wearer's forehead, jaw, cheeks, mouth, and ears.

13. A method of manufacturing a head and face protection apparatus, said method comprising the steps of:

providing a concave shell with a crown portion, forehead portion, chin portion, two jaw portions, and two side portions;

providing an elongated view opening between said forehead portion and said jaw portion;

connecting said forehead portion to said chin portion via said side portions and said jaw portions;

terminating said side portions vertically, toward the rear, prior to, the position where said side portions would extend over and cover an associated wearer's ears;

flaring said jaw portion and said side portions in an outward direction away from said associated wearer's face, such that the jaw portion and side portions form a concave shape;

terminating said crown portion intermediate to front half and back half of said associated wearer's head.

14. The method of claim 13 further comprising the steps of:

covering interior forehead surface of said forehead portion with padding; and, covering interior chin surface of said chin portion with padding.

15. The method of claim 13 further comprising the steps of:

providing a protective cage; and connecting said cage to said shell.

16. The method of claim 13 further comprising the steps of:

providing a harness device and an associated catcher's skull helmet.

17. The method of claim 16 further comprising the steps of:

strapping said shell to said associated catcher's skull helmet with said harness device.

18. The method of claim 17 further comprising the steps of:

covering interior forehead surface of said forehead portion with padding;

covering interior chin surface of said chin portion with padding;

providing a protective cage;

connecting said cage to said shell.

* * * * *